United States Patent [19]

Theurer

[11] Patent Number: 4,627,358

[45] **Date of Patent: * Dec. 9, 1986**

[54] CONTINUOUS ACTION TRACK LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[ * ] Notice: The portion of the term of this patent subsequent to Aug. 13, 2002 has been disclaimed.

[21] Appl. No.: 609,026

[22] Filed: May 10, 1984

Related U.S. Application Data

[63] Continuation-in-part of Ser. No. 498,261, May 26, 1983, Pat. No. 4,596,193.

[30] Foreign Application Priority Data

Sep. 9, 1982 [AT] Austria ..... 3386/82
Dec. 16, 1983 [AT] Austria ..... 4407/83

[51] Int. Cl.[4] ..... E01B 29/17
[52] U.S. Cl. ..... 104/7.2; 104/12
[58] Field of Search ..... 104/2, 7 R, 7 B, 12

[56] References Cited

U.S. PATENT DOCUMENTS

| | | | |
|---|---|---|---|
| 3,469,534 | 9/1969 | Plasser et al. | 104/7 B |
| 3,494,297 | 2/1970 | Plasser et al. | 104/7 B |
| 3,595,170 | 7/1971 | Plasser et al. | 104/12 |
| 3,687,081 | 8/1972 | Plasser et al. | 104/12 |
| 3,690,262 | 9/1972 | Plasser et al. | 104/7 R |
| 3,744,428 | 7/1973 | Plasser et al. | 104/12 |
| 3,762,333 | 10/1973 | Theurer et al. | 104/12 |
| 3,779,170 | 12/1973 | Plasser et al. | 104/12 |
| 4,356,771 | 11/1982 | Theurer | 104/7 B |
| 4,409,901 | 10/1983 | Hark | 104/7 B |

FOREIGN PATENT DOCUMENTS

| | | | |
|---|---|---|---|
| 1267322 | 3/1972 | United Kingdom . | |
| 2035423 | 6/1980 | United Kingdom | 104/7 R |
| 2077821 | 12/1981 | United Kingdom . | |
| 2094378 | 9/1982 | United Kingdom . | |

*Primary Examiner*—Randolph A. Reese
*Attorney, Agent, or Firm*—Kurt Kelman

[57] ABSTRACT

A mobile machine for leveling, lining and tamping a track, which comprises a heavy main frame supported on two undercarriages spaced apart for continuous movement in an operating direction, a drive for continuously advancing the main frame along the track in the operating direction, an operator's cab, a power plant and operating controls on the main frame, a lighter subframe leading one of the undercarriages in the operating direction, tamping heads mounted on the subframe for tamping ballast in intermittent tamping cycles under respective ties at points of intersection of the two track rails and the respective ties, a tract lifting and lining unit associated with the two rails mounted on the subframe ahead of the tamping heads in the operating direction, the subframe and the tamping heads and track lifting and lining unit mounted thereon constituting an operating unit and the tamping, lifting and lining unit is arranged within sight of the operator's cab, and a drive connecting the lighter subframe to the heavy main frame for adjusting the position of the subframe in relation to the main frame in the operating direction, the drive of the main frame and the drive for the subframe being synchronized whereby the subframe may be held stationary intermittently during each one of the tamping cycles while the main frame is advanced continuously. The power plant delivers power to, and the operating controls control, the drive and the tamping heads and track lifting and lining unit.

38 Claims, 14 Drawing Figures

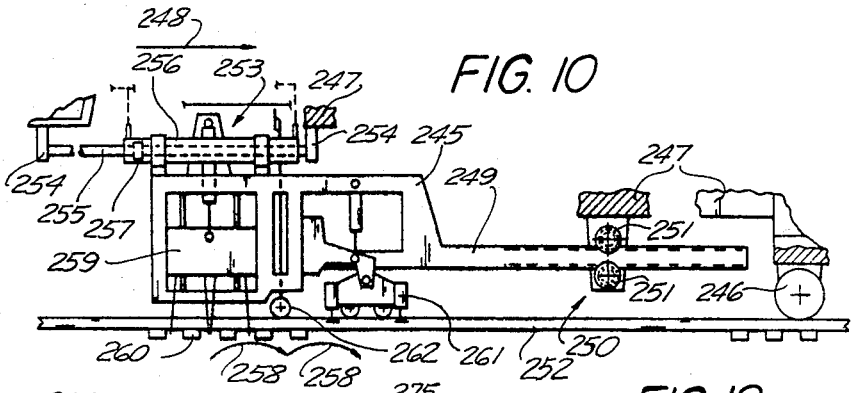
FIG. 10
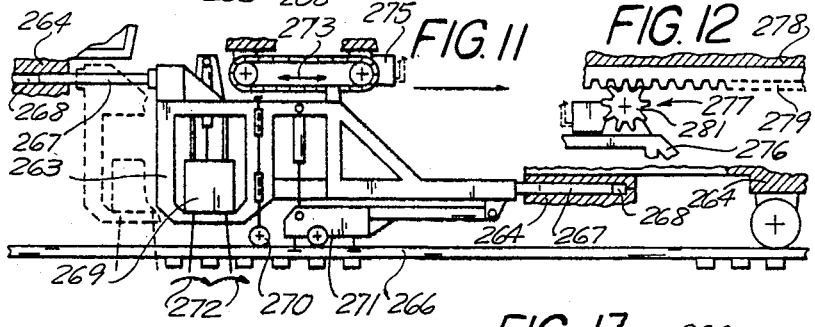
FIG. 11
FIG. 12
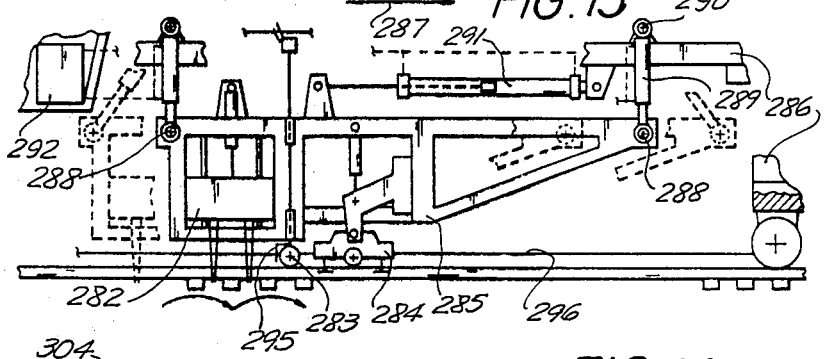
FIG. 13
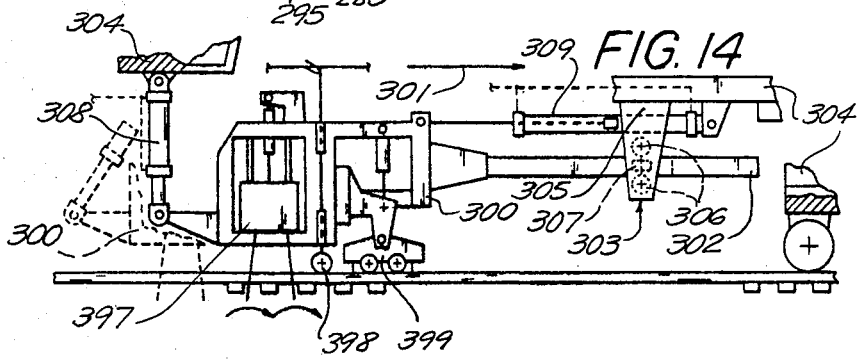
FIG. 14

CONTINUOUS ACTION TRACK LEVELING, LINING AND TAMPING MACHINE

This is a continuation-in-part of my copending U.S. patent application Ser. No. 498,261, filed May 26, 1983, now U.S. Pat. No. 4,596,193.

The present invention relates to a continuous action mobile machine for leveling, lining and tamping a track consisting of two rails fastened to successive ties resting on ballast.

U.S. Pat. No. 3,687,081, dated Aug. 29, 1972, discloses a mobile track leveling, lining and tamping machine with a continuously advancing machine frame longitudinally adjustably supporting respective tamping heads associated with each rail for movement with respect to the machine frame, the tamping heads being moved relative to the continuously advancing machine frame by a hydraulic cylinder-and-piston device in such a manner that the tamping heads are held stationary until each tamping cycle has been completed. The machine frame carries a track lifting and lining unit preceding the tamping heads in the operating direction. After the completion of each tamping cycle, the tamping heads must be rapidly advanced by the cylinder-and-piston devices until the tamping tools are centered over a succeeding tie to be tamped and lowering of the tamping heads at the new position initiates the next tamping cycle.

U.S. Pat. No. 3,494,297, dated Feb. 10, 1970, discloses mobile track tamping machines capable of simultaneously tamping a plurality of ties with a succession of ballast tamping units associated with each track rail. One of the embodiments of the disclosed machines has the above-described structure and the succession of tamping units is mounted on the second frame which has two sets of wheels spaced apart in the direction of the track for guiding the second frame therealong. Two jacks link the second frame to the first frame for vertically adjusting the second frame in relation to the first frame and the second frame is equipped with rail clamps in the region of the two sets of wheels for lifting the track when the second frame is raised. A track lining tool unit is mounted at the rear of the machine, in the operating direction. This arrangement enables the track to be leveled in two successive stages.

U.S. Pat. No. 3,779,170, dated Dec. 18, 1978, relates to a mobile track tamping, leveling and lining machine wherein the ballast tamping units associated with each rail are transversely adjustable on the main machine frame. An inductive sensor is associated with each tamping unit for sensing the transverse position thereof in relation to the associated rail and a resultant control signal from the sensor controls a transverse adjustment drive so that the ballast tamping units are always centered over their associated track rails and thus are accurately positioned not only in tangent track but also in curves.

In the mobile track tamper of U.S. Pat. No. 3,595,170, dated July 27, 1971, two twin tamping units are mounted on a carrier frame and are adjustably positionable in relation to each other in the direction of track elongation. The carrier frame of the tamping units is laterally pivotally or adjustably connected to the main machine frame to enable the tamping units to be repositioned laterally in alignment with a curvature in the track, the tamping units being arranged between two undercarriages supporting the machine on the track.

Since the carrier frame must support the weight and operating forces of all four tamping units, the frame structure must be massive and the pivoting or adjustment drive for the carrier frame requires considerable power.

U.S. Pat. No. 3,690,262, dated Sept. 12, 1972, discloses a mobile track tamping, laveling and lining machine with three undercarriages spaced apart in the direction of the track. A ballast tamping unit as well as a track leveling and lining tool unit are arranged between the center and rear undercarriages, in the operating direction, while the front undercarriage is adjustable in the track direction or the direction of elongation of the machine and may be vertically adjusted. In this manner, the machine frame may be selectively supported on the center or front undercarriage and the distance thereof from the track leveling and lining tool unit may be so adjusted in relation to the required lifting stroke for leveling the track that the track fails are only elastically deformed during the leveling operation and are not subjected to undue stresses which may cause permanent deformations in the rails. When the machine frame is supported on the front undercarriage, relatively large lifting strokes are made possible. On the other hand, the adjustability of the front undercarriage position makes it possible to maintain the proper wheel base when the machine is moved between working sites.

U.S. Pat. No. 3,687,081, dated Aug. 29, 1972, discloses a mobile track tamping, leveling and lining machine which advances non-stop and whose operating units are supported on elongated guides on the main frame of the machine. Suitable controls enable the units to be driven step-wise along the guides from tamping point to tamping point as the machine advances continuously. Similar arrangements for the combined use of track working cars some of which advance continuously while others advance step-by-step are shown in British Pat. No. 1,267,322, published Mar. 15, 1972.

U.S. Pat. No. 3,744,428, dated July 10, 1973, also discloses a mobile tamper with twin tamping units and the embodiment illustrated in FIG. 8 has two machine frames, each of which is supported on the track by front and rear undercarriages, and the two frames are linked together by a drive which is adjustable in the direction of the track. Each frame carries ballast tamping units and a track leveling and lining tool unit. The adjustable coupling between the two frames enables the tamping units on the two frames to be properly centered over respective ties to be tamped, regardless of variations in the crib widths. Although the common leveling reference system enables this machine to be somewhat simplified, compared to the use of individual machines operating in tandem, the total costs of the structural and control components is relatively high.

U.S. Pat. No. 4,356,771, dated Nov. 2, 1982, relates to a self-propelled track working machine which includes a control vehicle from which the operating units on a work vehicle may be remote-controlled.

U.S. Pat. No. 3,469,534, dated Sept. 30, 1969, discloses a mobile track tamping, leveling and lining machine. In certain embodiments of this machine, the machine frame has a cantilevered portion projecting beyond the front undercarriage and being pivoted to the frame, the cantilevered front portion of the frame carrying ballast tamping units and a track lifting tool unit. The machine frame is supported on the track on the front and a rear undercarriage, and a track lining tool unit is mounted thereon between the undercarriages.

Copending U.S. Pat. No. 4,457,234, filed Apr. 13, 1981, discloses a track tamping, leveling and lining machine with a track leveling and lining assembly having a bogie with a rear portion supporting the leveling and lining tools and a pole projecting forwardly from the rear portion. A ballast tamping assembly is mounted on the machine frame separately from the track leveling and lining assembly bogie and this bogie has its front end universally linked to the machine frame while the rear bogie portion is universally linked to the machine frame by the lifting drives. A pair of lining rollers mounted between pairs of lifting rollers supports and guides the bogie on the track. This arrangement assures a secure and stable engagement of the lifting and lining rollers with the track rails and an automatic centering thereof with respect to the rails, particularly in track curves.

Copending U.S. Pat. No. 4,430,946 filed Oct. 21, 1981, discloses a machine of this type wherein the ballast tamping assembly and the track leveling and lining assembly are separately mounted on the machine frame between the front and rear undercarriages thereof. The sequential arrangement of the tamping and stabilization assemblies provides an excellent stabilization of the tamped ballast for long-lasting support of the leveled and lined track because the effective operating ranges of the tamping tools and the track stabilization overlap.

It is the primary object of this invention to provide a continuous action track leveling, lining and tamping machine which is very compact, simple in structure and which enables the tamping means associated with each rail to work closely with the track lifting and lining means in an operating unit.

It is another object of the invention to increase the comfort of the machine operator by insulating the operator to a considerable extent from the noise and repeated impacts due to the intermittent motions of the tamping heads while enabling the operator to keep the machine operation in clear sight.

The above and other objects are accomplished according to the present invention in a mobile machine for leveling, lining and tamping a track, which comprises a heavy main frame supported on two undercarriages spaced apart for continuous movement in an operating direction, drive means for continuously advancing the main frame along the track in the operating direction, an operator's cab, a power plant and operating control means on the main frame, and a lighter subframe means leading one of the undercarriages in the operating direction. Tamping means are mounted on the subframe means for tamping ballast in intermittent tamping cycles under respective ties at points of intersection of the two track rails and the respective ties, and a track lifting and lining means associated with the two rails is mounted on the subframe means ahead of the tamping heads in the operating direction. The described and illustrated subframe means is a single subframe constituting an operating unit with the tamping, track lifting and lining means mounted thereon. The tamping, lifting and lining means is arranged within sight of the operator's cab. A drive connects the lighter subframe means to the heavy main frame for adjusting the position of the subframe means in relation to the main frame in the operating direction, the drive means of the main frame and the drive for the subframe means being synchronized whereby the subframe means may be held stationary intermittently during each one of the tamping cycles while the main frame is advanced continuously. The power plant delivers power to, and the operating control means controls, the drive and the tamping, track lifting and lining means.

This structure provides an embodiment of a mobile track tamper in which the ballast tamping head associated with each rail are independently and precisely guided so that they must fully follow the vertical and lateral path of the track whereby an exact centering of the tamping tools on the gage and field sides of each rail with respect to the center line of the track is assured when the tools are immersed in the ballast for tamping ballast under the ties. Since each tamping head conventionally comprises four to sixteen tamping tools which must be properly aligned with respect to each track rail, this automatic centering of the ballast tamping units is of great importance as far as an efficient and trouble-free tamping operation is concerned. This advantage is obtained in this embodiment by a freely movable steering axle of the subframe, which is the sole support and guide for the subframe on the track and whose free movement enables the subframe to follow the track since the other end of the subframe is merely pivotally connected to the main frame without any adjustment drive or position control. The pivotal connection between the subframe and main frame serves as the fulcrum for the free movement of the steering axle about this center of the axle's pivoting movement and this arrangement has considerable advantages over a tamping head frame which runs on the track independently of the main frame on rear and front undercarriages. Thus, the subframe necessarily follows the movement of the main frame to which it is pivotally connected at one end while the distance between this end and the steering axle at the other end, i.e. the pivoting radius of the steering axle about the fulcrum, which is decisive for the positioning of the subframe in track curves, may be freely selected, this distance being simply a function of the length of the subframe. At the same time, the support of the subframe loaded by the heavy weight of the tamping head on the track provides an advantage over conventional tampers wherein the weight is carried by the main machine frame because it substantially reduces the stresses to which the main frame is subjected through the connecting joint between the main frame and subframe, particularly if the distance between the pivotal connection of the subframe to the main frame and the steering axle supporting the subframe on the track is selected relatively large within the structural limits of the machine. Finally, the distribution of the total weight of the machine over the two main undercarriages and the steering axle, which may be a single-axle undercarriage or a swivel truck, reduces the load on the individual undecarriages, which is of particular importance when the machine is used on branch tracks normally capable only of receiving limited loads.

In another embodiment, wherein the operating unit is longitudinally adjustably connected to the main frame at two points spaced in the operating direction, a very cost-effective structure is provided which, in addition, greatly enhances the productivity of the machine compared to known continuous action tampers because the forces required for accelerating and stopping the operating unit between tamping cycles are applied only to the mass of the operating unit and not to the heavy main frame so that the same force applied to the drive for the subframe enables the advance to be effected much more quicly so that the time required for the tamping cycles is considerably reduced. Furthermore, the two longitudinally adjustable, spaced-apart connections between the main frame and the subframe are substantially rigid in a vertical direction and enable vertical forces to be transmitted. Since the ballast, particularly if it is encrusted, tends to resist the immersion of the tamping tools into the ballast when the tamping heads are lowered, which resistance may reach a force of the magnitude of several tons, this force will be transmitted from the subframe to the main frame through the connections so that the heavy main frame will serve as a counter-support for the absorption of the vertical forces resisting the downward movement of the tamping heads towards the ballast. The same is true for the transmission of the lifting forces of the track lifting means to the heavy main frame.

The above and other objects, advantages and features of the present invention will become more apparent from the following detailed description of certain now preferred embodiments, taken in conjunction with the accompanying drawing wherein FIG. 1 is a side elevational view of one embodiment of a mobile track leveling, lining and tamping machine according to this invention, which incorporates a twin ballast tamping unit;

FIGS. 10 to 14 are fragmentary, strongly simplified side elevational views showing modifications of the embodiment shown in FIG. 6.

Figures 1, 2:
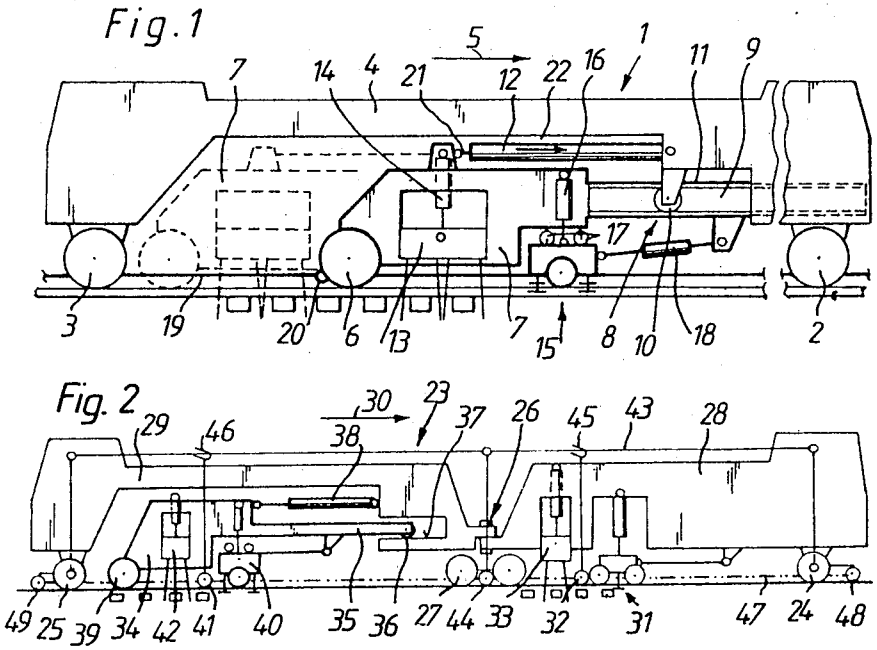
FIG. 2 is a like view of another embodiment with one-tie tamping head on two frames pivotally coupled together.

Referring now to the drawing and first to FIG. 1, there is shown mobile track leveling, lining and tamping machine 1 comprising heavy elongated, bridge-like main frame 4 supported on two undercarriages 2, 3 spaced apart for continuous movement in an operating direction indicated by arrow 5. Drive means continuously advances the heavy main frame along a track consisting of two rails fastened to successive ties resting on ballast. A subframe means constituted by lighter subframe 7 leads undercarriage 3 in the operating direction, the subframe being arranged between undercarriages 2, 3. Ballast tamping means 13 are mounted on subframe 7 for tamping ballast in intermittent tamping cycles under respective ones of the ties at points of intersection of the two rails and the respective ties. Track lifting and lining means 15 associated with the two rails is also mounted on the subframe ahead of tamping means 13 in the operating direction, the track lifting and tamping means being sufficiently spaced from the undercarriages of the main frame to permit leveling and lining of the track. As shown in the drawing, the subframe and the tamping, track lifting and lining means mounted thereon constitute an operating unit. Drive 12 connects lighter subframe 7 to heavy main frame 4 for adjusting the position of the subframe in relation to the main frame in the operating direction. The drive means of the main frame and the drive for the subframe are synchronized whereby the subframe may be held stationary intermittently during each tamping cycle while the main frame is advanced continuously. For this purpose, single support and guide element 6 supports and guides subframe 7 on the track adjacent undercarriage 3 of main frame 4 and pivotal connection 8 is spaced in the operating direction from the support and guide elements, the pivotal connection supporting the subframe on the main frame and drive 12 for the subframe being arranged at the pivotal connection.

Tamping means 13 is arranged immediately ahead of support and guide element 6 and track lifting and lining means 15 is arranged ahead of the tamping means. The illustrated tamping means comprises tamping heads of a known type capable of simultaneously tamping two adjacent ties.

The illustrated subframe has the form of a steering axle-and-pole frame, single support and guide element 6 consisting of a pair of flanged wheels supporting a rear portion of the frame on the track and constituting a freely movable steering axle of the frame. Tamping means 13 are mounted on the rear frame portion and pole 9 of the frame being a boom-shaped carrier extending from the rear frame portion forwardly in the operating direction in a plane centrally between the wheels. The pivotal connection is arranged for pivotally connecting the boom-shaped carrier to main frame 4. Boom-shaped carrier 9 is an I-beam whose upper flanges 11 are supported on a roller guide comprised of guide rollers 10 rotatably journaled in main frame 4 to form the pivotal connection, a lateral clearance between the vertical web of the I-beam and the rollers enabling the subframe to be slightly pivoted in a plane parallel to a plane defined by the track.

Each tamping head of the ballast tamping means comprises a tamping tool carrier and drive 14 for vertically adjusting the tamping tool carrier on subframe 7. A plurality of pairs of vibratory and reciprocatory tamping tools are mounted on each tamping tool carrier for immersion in successive cribs, with a respective tie position between the tools of the pairs. The track lifting and lining means comprises track lifting and lining tools and vertical and transverse drive means 16, 17 for the lifting and lining tools. As shown in the drawing, tamping tool carrier drive 14 projects upwardly from the rear frame portion and heavy main frame 4 defines an elongated recess extending in the operating direction for receiving the upwardly projecting drive.

Drive 12 is a hydraulic cylinder-and-piston device having respective ends linked to main frame 4 and subframe 7 of machine 1 for adjusting the position of the subframe in relation to the main frame. The drive is arranged to provide an adjustment path for the position of subframe 7 in relation to main frame 4 of a length at least twice the average distance between the track ties for enabling main frame 4 to advance continuously and non-stop along the track while the position of subframe 7 and ballast tamping means 14 thereon is adjusted stepwise during the continuous and non-stop advance as machine 1 moves from tamping cycle to tamping cycle. The respective end positions of this adjustment path are shown in broken and full lines in FIG. 1.

By adapting some of the principles disclosed in above-cited U.S. Pat. No. 3,690,262, this structure makes it possible to adjust the distance between the main frame undercarriages and track leveling and lining tool unit 15 in dependence of the required lifting stroke, which determines the deformation curve of the track rails. At the same time, it makes a non-stop operation of the machine possible. The track leveling and lining tool unit is also connected to pole portion 9 of the subframe by longitudinally adjustable rod 18. Machine 1 is also equipped with a conventional leveling and lining reference system which has been indicated only schematically by reference line 19, this system being connected to subframe 7 at 20 for movement therewith. Reference line 19 is comprised of a rod extending between front and rear track sensing elements respectively sensing the track rail positions in a section of the track to be corrected and a previously corrected track section, and moves along the track independently of main frame 4 of the machine. In this manner, the same spacing and measuring conditions prevail for the position of subframe 7 in relation to main frame 4 as for those of the elements sensing the actual position of the track and cooperating with reference line 19 so that correction errors are reduced.

The longitudinal adjustability of subframe 7 makes it possible to adjust the distance between steering axle 6 of the subframe and adjacent main frame undercarriage 3 so that this distance, as shown in broken lines, is as small as possible when a large lifting or lining stroke is required so that the distance between track leveling and lining tool unit 15 and front undercarriage 2 is as large as possible to reduce the flexing forces on the track rails and thus avoid permanent deformation of the rails. Where little or no lifting of the track is required, the distance between undercarriage 3 and steering axle 6 may be larger.

Most importantly, however, the above-described adjustability of the subframe in relation to the main frame makes it possible to advance machine 1 non-stop while intermittently tamping successive ties. During the tamping operation, subframe 7 remains stationary in the position shown in full lines in FIG. 1 so that the tamping tools are properly centered over the ties to be tamped while main frame 4 with support means 8 constituted by guide rollers 10 journaled in the main frame continuously advances in the operating direction indicated by arrow 5. Piston rod 21 of adjustment drive 12 is moved synchronously out of the drive cylinder. After the tamping operation has been completed, drives 14 are operated to lift the ballast tamping tools of tamping heads 13 out of the ballast and the adjusting drive, which is a double-acting hydraulic cylinder-and-piston device and comprises a valve arrangement controlling the piston movement of the device synchronously with, but in the opposite direction of, the continuous and non-stop advance of the main frame, is operated to retract the piston in the direction of the arrow shown in the cylinder subframe 7 is then relatively rapidly moved forwardly a distance of about three crib widths so that the tamping tools of tamping heads 14 are again centered over the next succeeding track ties. The tamping cycle is then repeated. The control means for these movements will be described hereinafter in connection with FIGS. 3 and 4.

An adjustment path of at least twice the average distance between the ties has the advantage that the non-stop advance of the machine need not be interrupted even if the tamping operation takes an unduly long time, for example in a heavily encrusted ballast. The ample dimensioning of the adjustment path provides a sufficient time reserve for a full completion of the required tamping, even if the tamping tools have to be immersed twice in the ballast, while the hydraulic drive enables the subframe rapidly to be moved into the succeeding tamping position. It is recommended for safety reasons to provide suitable end switches which will stop the machine when the subframe has reached its rear end position and the tamping operation still has not been completed. With this arrangement, a combined leveling, lining and tamping machine has been provided for the first time with a capability of efficient, simple and trouble-free continuous and non-stop advance during the entire track correcting operation along a stretch of track. This machine is of particular advantage in resurfacing track sections designed for fast trains. Operating personnel is not subjected to the physical strain of constant stop-and-go advances as tamping proceeds intermittently from tamping cycle to tamping cycle.

FIG. 2 shows mobile track leveling, lining and tamping machine 23 comprising a two-part main frame 28, 29 supported on undercarriages 24, 25 for mobility on the track in an operating direction indicated by arrow 30. The two main frame parts 28 and 29 are coupled together by pivot bearing 26 and swivel truck 27 supports the two frame parts in the range of the pivot bearing. Front frame part 28 carrying track leveling and lining unit 31, track sensing element 32 and ballast tamping heads 33 is structured along the lines of a conventional single-tie tamper. Elongated, bridge-type rear main frame part 29 is built on the principles of the present invention and has subframe 34 linked thereto, the subframe being supported independently on the track by steering axle 39 and being similar in structure to the subframe of FIG. 1. The free end of elongated boom-shaped pole portion 35 of subframe 34 carries roller 36 guided and supported on elongated guide track 37 on the main frame of machine 23. Longitudinal adjustment drive 38 links subframe 34 to main frame part 29. Ballast tamping heads 42 are mounted on the rear portion of the subframe and track leveling and lining tool unit 40 is linked to the subframe in the manner described in connection with FIG. 1, track sensing element 41 being arranged between units 40 and 42.

Machine 23 is equipped with a leveling reference system comprising respective tensioned reference wire 43 associated with each rail, the front and rear ends of the reference wires being supported, respectively, on front and rear undercarriages 24, 25 and an intermediate portion of the reference wires being supported on further track sensing element 44 arranged in the range of swivel truck 27. Rotary potentiometers 45, 46 respectively associated with sensing elements 32, 41 cooperate with the references wires in a known manner to produce control signals for the leveling operation. The machine is further equipped with a lining reference system comprising tensioned wire 47 shown in chain-dotted lines and extending centrally between the track rails. The ends of the lining reference wire are anchored respectively to track sensing elements 48, 49 and lining sensors (not shown) associated with elements 32, 41 cooperate with the lining reference wire to produce the required lining control signals.

This combined machine may be advantageously used for various purposes. For instance, by operating only the front main frame part, it may be used as a single-tie tamper advanced intermittently from tie to tie for tamping a track section. Alternatively, by operating only rear main frame part 29, the machine may be advanced non-stop during the entire tamping operation. Furthermore, if all operating units 31, 33 and 40, 42 are used, the machine operates in a tandem method wherein the tamping tools of tamping heads 33 are first centered on a tie to be tamped and the tamping tools of tamping heads 42 are then centered by actuating drive 39 for tamping a succeeding tie. In this manner, two ties can be tamped at the same time where the crib widths are irregular. Also, the track may be lifted by a relatively large lifting stroke in two successive lifting phases by units 31 and 40.

Figures 3, 4, 5:
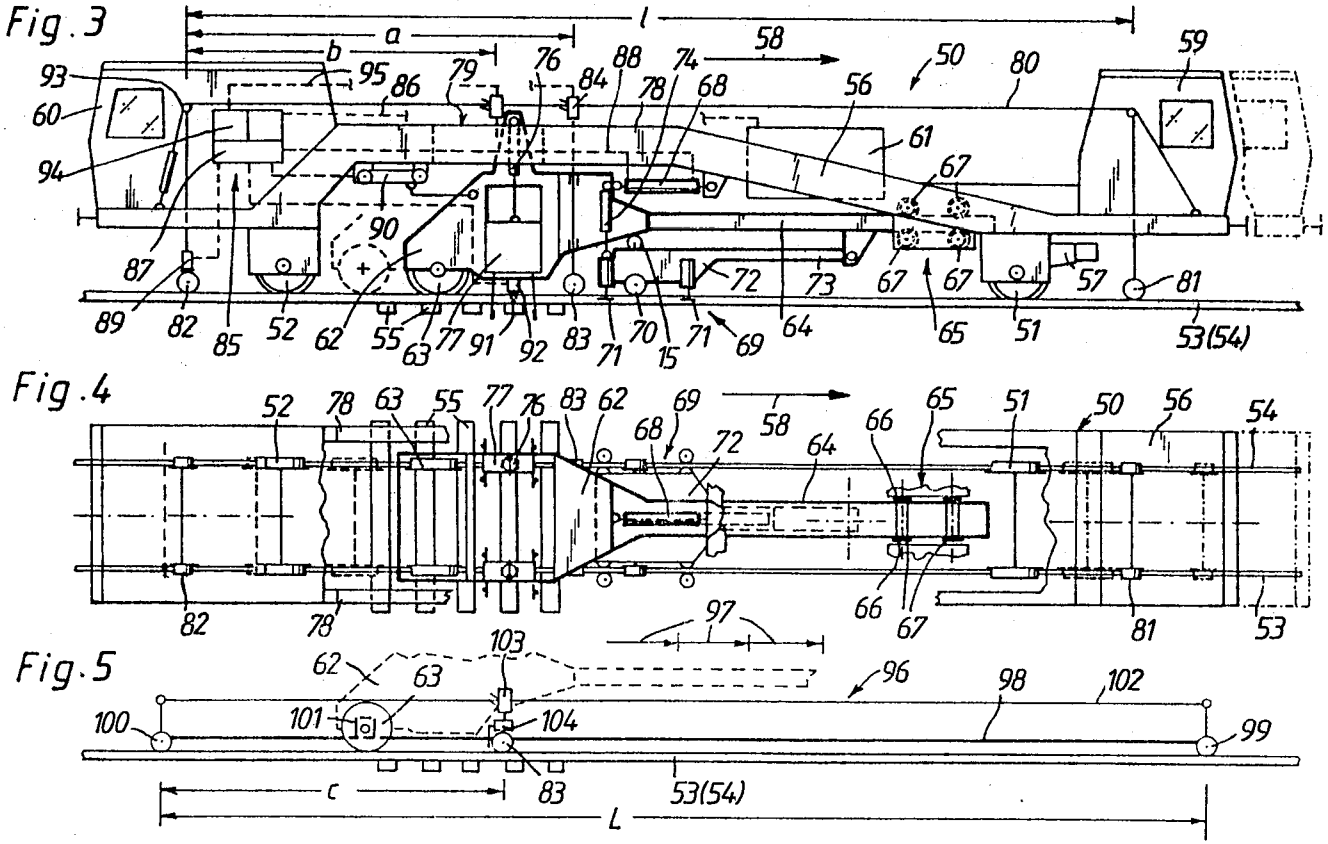
FIG. 3 is an enlarged side elevational view of a particularly preferred embodiment of a mobile track leveling, lining and tamping machine according to the invention.
FIG. 4 is a top view of the machine of FIG. 3, with a fragmentary showing of the main frame.
FIG. 5 is a side elevational view of an embodiment of a leveling and lining reference system for the machine of FIGS. 3 and 4.

FIGS. 3 and 4 illustrate a particularly preferred track leveling, lining and tamping machine 50. This machine comprises main frame 56 supported on undercarriages 51, 52 on the track for mobility in an operating direction indicated by arrow 58. Drive means 57 is connected to the wheels of front undercarriage 51 for continuously advancing the main frame along the track in the operating direction. The front and rear ends of main frame 56 respectively carry operator's cabs 59 and 60, and power plant 61 is also mounted on the main frame. All the operating units of machine 50 are mounted on subframe 62 whose steering axle 63 supports a rear portion of the subframe on the track while its elongated boom-shaped pole portion 64 projects forwardly therefrom, support means 65 supporting the front end of the pole portion on main frame 56. The support means is comprised of a roller guide illustrated as two pairs of guide rollers 67 rotatably journaled in main frame 56 for rotation about a horizontal axis extending transversely to the operating direction. The pairs of rollers are spaced in the operating direction a distance corresponding at least to the length of the adjustment path of subframe 62. The rollers of each pair engage boom-shaped carrier portion 64 therebetween and have guide flanges 66 engaging this carrier portion. A lateral clearance between carrier portion 64 and guide flanges 66 of rollers 67 enables subframe 62 to be slightly pivoted about support means 65 so that this support means pivotally connects the carrier frame to the main frame and steering axle 63 for the subframe is freely movable. Drive 68 is arranged between main frame 56 and subframe 62 for adjusting the position of the subframe relative to the main frame in the operating direction.

This very simple pivotal connection between the subframe and the main frame assures a substantially friction-free longitudinal adjustability therebetween while, at the same time, providing sufficient free lateral movement of the subframe. The specific roller guide is capable of transmitting relatively large weights and operating stresses, particularly where large lifting strokes are involved and/or if such heavy track sections as switches must be lifted.

Drive 68 for adjusting the position of subframe 62 relative to main frame 56 in the operating direction is a double-acting hydraulic cylinder-and-piston device extending in this direction and arranged above track leveling and lining tool unit 69 at a vertical distance from the track substantially corresponding to the height of subframe 62, and universal joints connect respective ends of device 68 to frames 56 and 62, respectively. This arrangement has the particular advantage that the longitudinal adjustment forces are transmitted to subframe 62 immediately above elongated carrier portion 64 so that the support means thereof on main carrier 56 is not subjected to any substantial torque during the longitudinal adjustment.

Carrier frame 72 of track leveling and lining unit 69 has a rear portion guided along the track rails by flanged lining rollers 70 and pairs of laterally pivotal lifting rollers 71 and a forwardly projecting pole portion 73 having a front end linked to pole portion 64 of subframe 62. Lifting and lining drives 74 and 15 link the rear portion of unit 69 to subframe 62. Again, as in the other embodiment, vertical adjustment drive 76 links respective tamping head 77 associated with each track rail 53, 54 to the subframe. The main frame has two upwardly recessed beams 78 defining elongated opening 79 for receiving vertical adjustment drives 76.

Machine 50 is equipped with a leveling reference system comprising a tensioned reference wire 80 associated with each rail, a front end of the wires being anchored to track sensing element 81 running on a track section to be corrected and the rear ends of the wires being anchored to track sending element 82 running on a previously corrected track section. Track sensing element 83 is guided along the track rails without clearance between tamping heads 77 and track leveling and lining tool unit 69 and carries rotatory potentiometer 84 cooperating with each reference wire 80 for emitting control signals for the leveling of the track. A lining reference system particularly useful for machine 50 will be described hereinafter in connection with FIG. 5.

This machine is further equipped with a number of auxiliary devices for the automatic control of various movements during the continuous, non-stop advance of main frame 56 and the intermittent advance of subframe 62 with ballast tamping heads 77 during a tamping operation. This operating control means comprises control panel 85 in cab 60 and which includes valve arrangement 87 in a hydraulic circuit 86 (indicated schematically in broken lines) connecting a source a hydraulic fluid in power plant 61 to double-acting cylinder-and-piston device 68. The valve arrangement controls the piston movement of the device synchronously with, but in the opposite direction of, the continuous and non-stop advance of main frame 56. Three alternative embodiments of such a control have all been illustrated in FIG. 3 for the sake of simplifying the drawing.

In one embodiment, odometer 89 is connected to valve arrangement 87 for measuring the advance of the main machine frame during each tamping cycle. The illustrated odometer forms a structural unit with track sensing element 82. It is designed to emit a control pulse to the valve arrangement for each unit of length the main machine frame has advanced, for example for each centimeter of advance. In this manner, the odometer controls the valve arrangement in response to the measured advance for controlling the hydraulic pressure on the piston in the cylinder chamber to the right of the piston and thereby controlling the piston movement in response to the measured advance in synchronization with, but in the opposite direction to, the non-stop advance of the main frame. Therefore, subframe 62 with ballast tamping heads 77 will remain stationarily centered over tie 55 being tamped while main frame 56 continuously advances. As soon as tamping is completed and the ballast tamping heads are raised, a suitable control responsive to the vertical tamping head movement, for example a limit switch in the path of the rising tamping head, operates valve arrangement 87 to apply hydraulic pressure to the cylinder chamber to the left of the piston so that drive 68 will rapidly advance subframe 62 in the operating direction for centering the tamping tools of heads 77 over the next tie to be tamped. When the tamping heads are lowered again for immersion of the tamping tools in the ballast to initiate the next tamping cycle, odometer 87 is re-set to zero to be ready for the next operating cycle.

Such a control is very simple and makes use of odometer means successfully used for a long time in various track surfacing machines.

The same result can be obtained with a measuring element connected to valve arrangement 87 for measuring the adjustment path of subframe 62 relative to main frame 56. The illustrated measuring element is a cable tensiometer 90 comprising a cable line controlled by a potentiometer. In this case, the piston movement control of drive 68 is proportional to the adjustment path and to the output voltage of the potentiometer emitted as an analog signal. This control provides great precision in the operation of adjustment drive 68 and thus assures the maintenance of accurate centering of the tamping tools over the tie being tamped during the entire tamping operation.

Finally, inductive signal transmitter 92 may be connected to valve arrangement 87 for providing the desired control. Transmitter 92 is mounted on subframe 62, preferably centrally with respect to ballast tamping head 77, and is arranged for cooperating with, and for centering with respect to, respective ferrous fastening elements 91 affixing rails 53, 54 to ties 55. As long as transmitter 92 remains centered with respect to the fastening element affixing the rail to the tie being tamped, it emits no signal, i.e. it remains inert. It emits a stronger or weaker control signal upon deviation of the transmitter from a center position and dependent on the direction of deviation. These control signals control valve arrangement 87 for controlling the hydraulic pressure on the piston and thereby control the piston movement. This assures continued centering of the tamping tools over the tie being tamped. This control, too, requires no further development work because such inductive signal transmitters have long been used in this art, for example in the automatic control of the forward movement of track maintenance machines and in other applications.

Finally, a relative movement between the main frame and subframe may also be obtained simply by braking the steering axle of the subframe and applying no pressure to the piston of the double-acting cylinder-and-piston adjustment drive while the main carrier advances non-stop so that the subframe is held in a fixed position during the tamping operation as the main carrier continues to advance.

As appears from FIG. 3, the ratio of distances and, thus, the ratio for reducing the track position errors changes during the tamping operation and the continuous advance of the machine while tamping takes place. In the forward end position of subframe 62 (shown in full lines), sensor 84 connected to track sensing element 83 for transmitting a leveling control signal corresponding to the sensed track position has a relatively large distance a from rear reference point 93 of reference wire 80. This produces a ratio for reducing the track level error of a/l, wherein l is the total length of the reference wire. In the rear end position of the subframe (shown in broken lines), the distance between sensor 84 and reference point 93 is reduced to b so that an improved ratio b/l for reducing the track level error results. This means that the ratio for reducing the track level error is the best towards the end of the tamping operation, i.e. at the time when the leveled track is fixed in its position by tamping ballast under the tie. However, it is necessary to take these distance ratios into account by appropriate measuring means. For this purpose, control panel 85 further comprises computer means 94 connected by signal transmission line 95 to sensor 84 mounted on subframe 62 between ballast tamping heads 77 and track leveling and lining means 69 for determining the variable distance of the sensor from reference system rear end point 93 when the position of frame 62 in relation to frame 56 is adjusted and for correcting the respective value measured by the sensor according to the determined distance. The computer means is also connected to measuring element 89 or 90 so that the influence of the different distances a and b on the leveling result is compensated. The measuring element is connected to the valve arrangement 87 for measuring the adjustment path of the subframe and controls the valve arrangement in response to the measured adjustment path for controlling the hydraulic pressure on the piston and thereby controlling the piston movement in response to the measured adjustment path, computer means 94 being connected to the measuring element.

With this arrangement, it is possible to use a conventional leveling and lining reference system which moves with the main frame of the machine along the track and to compensate for the changes in the distance between the reference point where the actual track position is read and the rear reference point which indicates the corrected track position, which occur during the tamping operation because the main frame moves relative to the carrier frame. As indicated, the ratio for reducing the rack position error improves as the track position correction proceeds and has the most favorable value in the end phase of the operation when the track is fixed in its corrected position. When the computer is also connected to an element measuring the adjustment path between the main and carrier frames, whose length determines the distance between the sensor reading the actual track position and the reference end point indicating the corrected track position, this varying distance is precisely determined and can be fed to the computer means as one of the variables.

As clearly appears from the drawing, it is highly advantageous to mount the subframe with its steering axle-supported rear portion carrying the ballast tamping heads and the forwardly projecting pole portion housing the track leveling and lining tool unit within an elongated, upwardly recessed portion of the main frame. This construction is very space-saving while affording the required freedom of movement to the subframe with its operating units. At the same time, the operating units are readily accessible for repairs, maintenance work or replacement. When the main frame is a structure composed of two side beams, excellent visibility conditions are afforded to the operator in cab 59 within sight of the tamping, track lifting and lining means. Power plant 61 delivers power not only to drive 68 but also to the tamping, track lifting and lining means, all of which are controlled by the operating control means in the main frame.

FIG. 5 schematically illustrates combined leveling and lining reference system 96 with which machine 50 may be equipped. This system moves stepwise and independently of main machine frame 56 with subframe 62 from tamping point to tamping point, as is indicated by arrows 97. For this purpose, rod 98 is arranged centrally between the track rails to form a lining reference line, a forward end of rod 98 being anchored to track sensing element 99 guided along the rails in an uncorrected section of the track while the rear end of the rod is anchored to track sensing element 100 guided along the rails in the previously corrected track section and coupled to subframe 62 by connecting element 101. This connecting element, which may engage steering axle 63 of the subframe, for example, is arranged to assure movement of rod 98 with the subframe but free movability of the rod in a direction transverse to the track. The leveling reference comprises tensioned reference wires 102 extending between sensing elements 99 and 100 above track rails 53, 54. Track sensing element 83 is associated with subframe 62 and cooperates with reference system 96 for measuring the differences between the actual and desired level and line of the track. For this purpose, measuring sensors 103, which may be rotary potentiometers, cooperate with reference wires 102 for generating a leveling control signal and measuring sensor 104 mounted centrally between the rails cooperates with rod 98 for generating a lining control signal. This leveling and lining reference system produces a constant ratio c/L of distance c between track sensing element 83 measuring the actual track position and rear track sensing element 100 measuring the desired (previously corrected) track position, and length L of the reference system.

In the embodiments illustrated in FIGS. 6 to 14, the operating unit of the present invention is longitudinally adjustably connected to the main frame at two points spaced in the operating direction.

Referring first to FIGS. 6 to 9, there is shown nonstop advancing track leveling, lining and tamping machine 201 comprising heavy frame 207 supported on two undercarriages constituted by swivel trucks 202, 203 for continuous movement in an operating direction of a track consisting of rails 204 fastened to successive ties 205 resting on ballast. Drive means 206 continuously advances the main frame along the track in the operating direction indicated by arrow 208. Operator's cab 209 on main frame 207 is equipped with driving and control panel 210 and recording instrument 211 receiving characteristic parameters inscribed on the track. Power plant 214 delivering power to all the operating units of machine 201 is mounted on heavy main frame 207 in housing 213 behind operator's cab 209, in the operating direction, between the two lateral carrier beams 212 of the main frame. A second operator's cab 215 is mounted on main frame 207 at the rear end thereof. This cab houses, in addition to driving and control panel 210, central operating control means 216 for the operating unit.

The operating unit is constituted by lighter subframe 219 leading rear undercarriage 203 in the operating direction, tamping means 217 mounted on the subframe for tamping the ballast, and track lifting and lining means 218 associated with the two rails, the track lifting and lining means being mounted on subframe 219 ahead of tamping heads 217. As shown, the tamping, track lifting and lining means are within sight of operator's cab 209. The operating unit is longitudinally adjustably connected to main frame 207 at two points 221 and 224 spaced in the operating direction. A rear portion of subframe 219, which has the form of a framework, carries the tamping, track lifting and lining means, and a front portion of the subframe is constituted by longitudinal carrier means 220 supported on main frame 207 for guiding the subframe at point 221. Two longitudinal guides 224 respectively arranged along oppositely extending, lateral sides of the main frame support the rear subframe portion of the subframe, the lateral main frame sides being constituted by elongated carrier beams 212 extending above rails 204. Longitudinal carrier means 220 of subframe 219 is constituted by carrier beams 220 also extending above rails 204. As illustrated, tamping heads 217 are mounted on the rear subframe portion and guides 224 are arranged at an upper part of the rear subframe portion. Carrier beams 220 are arranged for guiding subframe 219 between track lifting and lining means 218 and undercarriage 202 of the main frame and bracket means 230 extend downwardly from the main frame for supporting the longitudinal carrier beams 220.

The means for longitudinally adjustably connecting the lighter subframe to the heavy main frame comprises roller guide means for the subframe at each point 221, 224. Each illustrated roller guide means includes a first guide means part consisting of at least two rollers 223 and 225 rotating about horizontal axes 222 extending transversely to the operating direction and a second guide means part consisting of a roller guide track having an upper and a lower guide face extending horizontally in the operating direction. One of the rollers engages the upper guide face and the other roller engages the lower guide face substantially without clearance. One of the guide means parts is mounted on main frame 207 and the other guide means part is mounted on subframe 219. In the illustrated embodiment, the one guide means part of roller guide means 224 comprises longitudinal main frame carrier beams 212 as guide tracks for supporting the rear subframe portion and the one guide means part of roller guide means 221 comprises rollers 223 for supporting a front portion of the subframe. The other guide means part of roller guide means 224 comprises rollers 225 engaging the upper and lower faces of carrier beams 212 and the other guide means part of roller guide means 221 comprises the two subframe carrier beams 220 serving as guide tracks, rollers 223 engaging the upper and lower faces of carrier beams 220.

In the illustrated embodiment of the roller guide means, the rollers have a flange arranged for engagement with a respective lateral edge of the guide track. Roller guide means 224 has two flanged rollers 225 engaging the upper face of carrier beam 212 and one flanged roller engaging the lower face of the carrier beam without clearance.

Adjustment drive 227 enables subframe 219 to be advanced intermittently, this intermittent movement being symbolized by arrows 226, and the drive is a double-acting hydraulic cylinder-and-piston device, the cylinder of the device constituting drive actuating means connected to the main frame and receiving hydraulic fluid from power plant 214. It is also possible to connect the cylinder to the subframe and the piston rod to the main frame. Those skilled in the art will choose one or the other structural modification from the point of view of obtaining the best possible driving force transmission and making best use of the available space. The respective ends of the cylinder-and-piston device are connected by universal joints to the subframe and main frame, respectively, and the device extends in the operating direction substantially centrally between the track rails. Such an adjustment drive has a very simple structure, is robust and works dependably. It also enables the adjustment path to be controlled precisely and with simple control means, including automatic controls. A forward end position of subframe 219 is shown in full lines in FIG. 6 while its rear end position is indicated in broken lines.

While the subframe has been described and illustrated with two carrier beams 220 above the two rails, it would be possible to use a certain projecting pole, as in the previously described embodiments. In either modification, the illustrated roller guide means provide a very solid but simple adjustable support of the lighter subframe on the heavy main frame, the heavier rear portion of the subframe, which is also subjected to the operating forces of the machine, being safely supported on three-roller guide 224. Since this guide is arranged at the top of the subframe above the tamping means, the tamping forces will be transmitted directly from the tamping means to the carrier beams of the main frame. Guiding carrier beams 220 of the subframe in downwardly projecting bracket means 330, wherein rollers 223 are journaled, enables the space thereabove to be used for mounting power plant 214. In addition, the lower arrangement of the forward guide means lowers the point of gravity of the operating unit on which the two tamping heads 217 and track lifting and lining unit 218 are mounted so that its stability is further enhanced. The illustrated roller guide means reduce the friction forces encountered during the adjustment of the subframe to a minimum, only the rolling forces of the rollers along the engaged faces having to be overcome. This considerably contributes to the rapid pace of the adjustment and thus increases the productivity of the machine. If the rollers engage the track guide faces substantially without clearance, which may be assured, for example, by mounting the roller axles vertically adjustably, repeated impacts or vibrations caused by any play between the rollers and the guide tracks are avoided, thus eliminating the noise produced by such impacts or vibrations. If flanged rollers are used, they will simultaneously serve for lateral guidance.

Figures 6, 7, 8, 9:
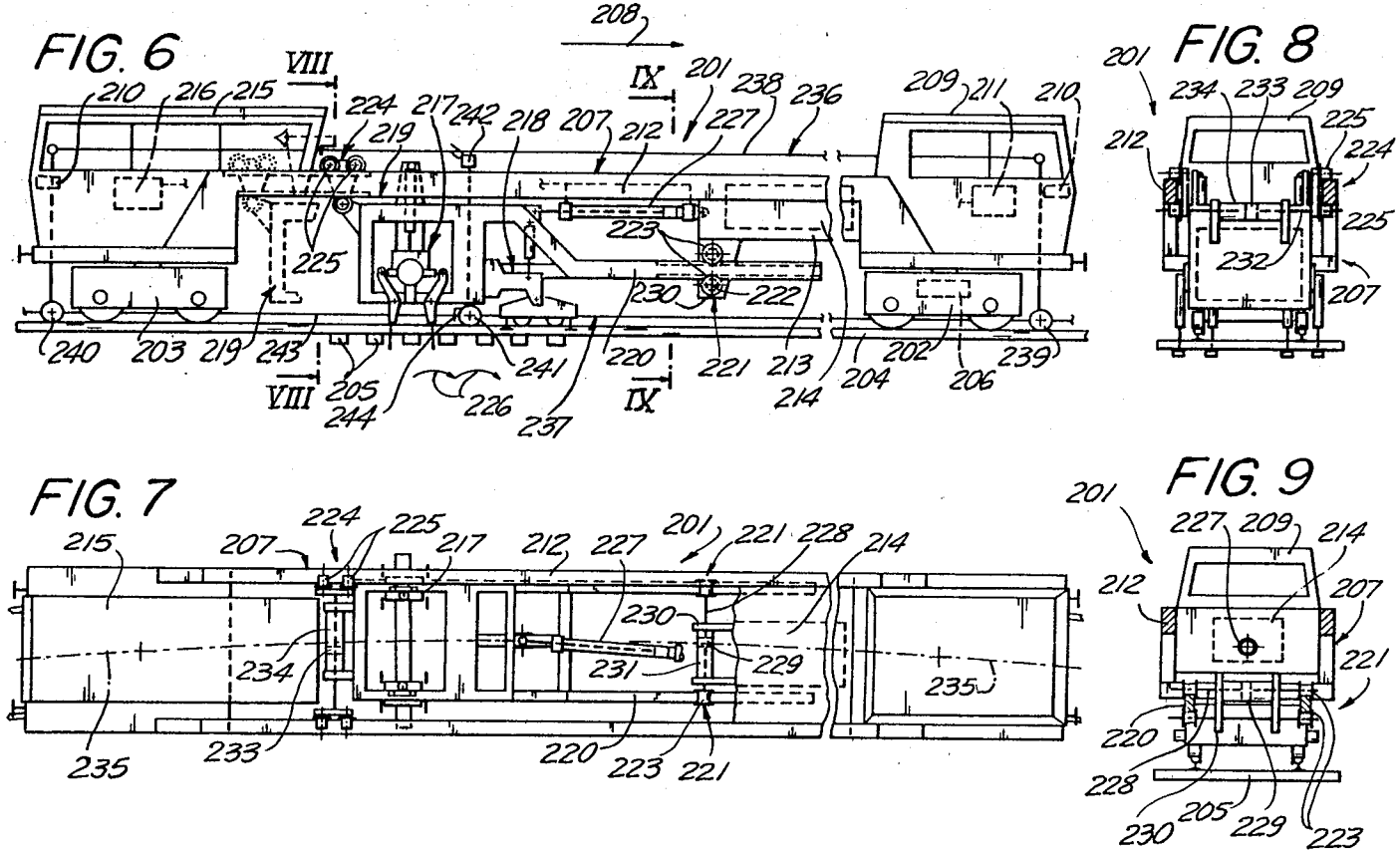
FIG. 6 is a like view of yet another embodiment of a track leveling, lining and tamping machine according to the invention.
FIG. 7 is a schematic, simplified top view of the machine of FIG. 6, operating in a track curve.
FIG. 8 is a sectional end view along line VIII—VIII of FIG. 6.
FIG. 9 is a further sectional end view along line IX—IX of FIG. 6.

The operating unit of FIGS. 6 and 7 is additionally adjustable transversely to the operating direction indicated by arrow 208 with respect to main frame 207 in a plane of movement extending substantially parallel to a plane defined by the track. Guide and drive means for transversely adjustably bearing subframe 219 comprises piston rod 228 having piston 229 centrally between the piston rod ends connected to upper rollers 223 of roller guide means 221 for guiding the front portion of the subframe transversely and double-acting hydraulic cylinder 231 encompassing the piston rod and piston for driving the subframe for transverse adjustment of the operating unit. The cylinder is affixed to brackets 230 of the main frame. In a similar manner, the ends of piston rod 232 having piston 233 are connected to lower rollers 225 of the two roller guide means 224 at the sides of the machines for guiding the rear portion of the subframe transversely and double-acting hydraulic cylinder 234 encompasses the piston rod and piston for driving the subframe for transverse adjustment of the operating unit. When the machine operates on straight tangent track, pistons 229 and 233 remain centered so that subframe 219 has a centered position with respect to main frame 207 in the transverse direction, as shown in FIGS. 8 and 9. In this position, the tamping tools are properly centered over rails 204, as shown in FIG. 8. When the machine operates in a track curve, as shown in FIG. 7 wherein chain-dotted line 235 indicates the arcuate center line of the track, the lateral centering of the tamping heads is assured by delivering hydraulic pressure to drive cylinders 231 and 234 so that the subframe is laterally displaced until the two ramping heads are again mirror-symmetrically disposed with respect to center line 235. This transverse adjustment may be effected by the operator in cab 215 manually or, as is well known, automatically by track sensing elements controlling the delivery of hydraulic fluid to the drive cylinders. This arrangement enables the proper centering of the tamping tools over the two rails even in tight curves and the use of the illustrated transverse guide and drive means provides a very simple structure capable of sustaining the heavy loads and forces of the tamping, track lifting and lining means. In the illustrated embodiment, essential parts of the roller guide means, the transverse guide means and the transverse drive means are combined into a simple and space-saving unit, which provides another cost-saving feature of the machine.

Machine 201 is equipped with leveling reference system 236 and lining reference system 237 (not shown in FIG. 7 for sake of simplicity). Leveling reference system 236 comprises two tension wires 238 extending above rails 202, respective end points of the tension wires being supported on rail sensing elements 239 running on the rails in an uncorrected track section and rail sensing elements 240 running on the rails in a previously corrected track section. Rail sensing element 241 runs on rails 204 in the range of the track section between tamping heads 217 and track lifting and lining unit 218, element 241 supporting track level sensor 242 which engages tensioned reference wire 238 for determining the prevailing track level. Lining reference system 37 comprises tensioned wire 243 which extends between measuring bogies (not shown) respectively leading and trailing the machine in the uncorrected and corrected track sections. Rail sensing element 241 engages tensioned reference wire 243 and carries measuring sensor 244 for determining any difference between the prevailing lateral position of the track and the desired lateral track position. The structure and operation of the reference systems are entirely conventional and will, therefore, not be further described.

Any transmission of sound and impact from the subframe to the main frame will be reduced if the means for longitudinally adjustably connecting the operating unit to the main frame comprises sound and impact damping means. Such damping means will not only reduce the wear of the operating forces and weight on the main frame but also provides a more comfortable working environment for the operators.

FIG. 10 shows subframe 245 and only fragments of heavy main frame 247 to illustrate the means for longitudinally adjustably connecting the operating unit to the main frame, front undercarriage 246 of the main frame also being shown. Arrow 248 indicates the operating direction of the machine. As in the embodiment of FIG. 6, the rear portion of subframe 245 has the form of a framework or trussing and two carrier beams 249 project therefrom to form a front portion of the subframe, roller guide means 250 having flanged rollers 251 respectively engaging the upper and lower faces of the two carrier beams, preferably without substantial clearance. Longitudinally adjustable means 253 above track rails 252 support the rear portion of subframe 249 on main frame 247 and comprises two double-acting hydraulic cylinder-and-piston devices. Piston rods 255 of these devices have pistons 257 and extend in the operating direction to serve as guide posts, the ends of the piston rods being affixed to main frame 247. Cylinders 256 are affixed to the subframe, being mounted on brackets on top of subframe 245, thus providing a drive for adjusting the position of the subframe with respect to the main frame in intermittent steps, as indicated by arrows 258. Tamping heads 259 for the simultaneous tamping of two adjacent ties 260 are mounted on the rear portion of the subframe below cylinders 256 in association with the two track rails. Track lifting and lining unit 261 is arranged on the subframe ahead of the tamping heads. Rail sensing elements 262 run on rails 252 between tamping heads 259 and track lifting and lining unit 261 for association with leveling and lining reference systems of the type described hereinabove. Adjustment drive 253 makes it possible to apply relatively large driving forces to provide a rapid adjustment movement for the operating unit.

In the embodiment of FIG. 11, subframe 263 is again longitudinally adjustably connected to main frame 264 continuously advancing in an operating direction indicated by arrow 265. The means for longitudinally adjustably connecting the operating unit to the main frame comprises four guide posts 267 extending in vertical planes defined by the two rails 266 and above the rails, two guide posts projecting from a front end and two guide posts projecting from a rear end of subframe 263. Guide bushings 268 affixed to main frame 264 glidably receive respective guide posts 267. This arrangement provides a very accurate and tight lateral and longitudinal guide for the subframe with respect to the main frame.

Subframe 263 carries tamping heads 269 and track lifting and lining unit 271 wherebetween rail sensing element 270 is arranged. The drive for adjusting the position of the subframe intermittently, as indicated by arrows 272, is constituted by motor-driven endless chain drive 274 arranged on main frame 264. The chain has a course extending in the operating direction and is arranged to entrain the subframe in that direction. As indicated by double-headed arrow 273, the chain drive is reversible and the lower chain course is linked to subframe 263. Chain drive motor 275 is also mounted on the main frame. Such an adjustment drive is very robust and requires little maintenance. The rear adjusted position of the subframe is shown in broken lines in this figure.

The adjustment drive for subframe 276 illustrated in FIG. 12 is constituted by rack-and-pinion drive 277 comprising rack 279 extending in the operating direction and pinion 281 driven by motor 280, the pinion meshing with the rack. Rack 279 is mounted on an underside of main frame 278, preferably centrally between the sides of the main frame while the motor-driven pinion is mounted on top of subframe 276. While the active drive means is mounted on the main frame in the embodiment of FIG. 11, it is mounted on the subframe in the embodiment of FIG. 12. In both embodiments, an hydraulic or electric motor may be used, possibly with an intermediate reduction gearing.

FIG. 13 illustrates an embodiment wherein subframe 285 carries twin tamping heads 282 and track lifting and lining unit 284 wherebetween rail sensing elements 283 are arranged. The means for longitudinally adjustably connecting the operating unit of this embodiment to main frame 286 comprises two longitudinally adjustable links 289 suspending the subframe for pendulum movement on the main frame at respective ends of the subframe. Links 289 at each subframe end are arranged oppositely each other with respect to a center line extending in the operating direction and the links are pivotal about parallel horizontal axes 288, 290 extending transversely to the operating direction. Despite the pendulum suspension of the subframe on the main frame, the subframe will maintain the same level between its front and rear end positions, i.e. it will always be displaced exactly parallel to the track plane. The longitudinal adjustability of the links enables the entire operating unit to be lifted when the machine is moved from one to another operating site.

In the illustrated embodiment, links 289 are hydraulic double-acting cylinder-and-piston devices whose cylinders are linked at their upper ends to pivot 290 on main frame 286 while the lower ends of their piston rods are linked to pivots 288 on subframe 285, the horizontal axes of the pivots extending parallel to each other in a direction transverse to the operating direction. The adjustment drive for subframe 285 is double-acting cylinder-and-piston device 291 whose ends are linked respectively to the main frame and the subframe by universal joints. As shown in broken lines, the cylinder chambers of drive 291 and links 289 are connected to control 292. The control is programmed to adjust the length of the links as a function of the adjustment path of the drive to a predetermined trigonometric function so that subframe 285 is displaced exactly parallel to the track plane as it swings about pivots 290 between a forward portion shown in full lines and a rear position shown in broken lines. In this way, the relationship of sensing element 283 and the track level sensor 293 to leveling reference system 294 and that of track ordinate sensor 295 to lining reference system 296 remains unchanged over the entire adjustment path of the subframe.

In the embodiment of FIG. 14, lighter subframe 300 has a rear portion constituted by a framework carrying tamping heads 397 and track lifting and lining unit 399 wherebetween rail sensing elements 398 are arranged, and the front portion of the subframe, in the operating direction indicated by arrow 301, is constituted by a single pole or carrier beam 302 projecting forwardly from the rear portion in a vertical center plane between the lateral sides of the subframe. This carrier beam is longitudinally adjustably supported in roller guide means 303 on downwardly extending brackets 305 of heavy main frame 304. The roller guide means comprises vertical guide rollers 306 engaging the upper and lower faces of carrier beam 302 as well as lateral guide rollers 307 engaging the opposite side faces of the carrier beam. As in the embodiment of FIG. 13, the rear portion of subframe 300 is suspended from main frame 304 by cylinder-and-piston devices 308 for pendulum movement in the operating direction. Adjustment drive 309 passes between brackets 305 and its ends are linked respectively to the subframe and the main frame by universal joints. The same type of control as described hereinabove operates links 308 in response to the adjustment path of drive 309 so that the rear subframe portion maintains the same vertical level as the subframe is positioned between a front position shown in full lines and a rear position shown in broken lines.

In all embodiments of the present invention, the subframe of the operating unit carries tamping means as well as track lifting and lining means associated with each rail of the track and the track lifting and lining means is sufficiently spaced from the next adjacent undercarriage of the main frame preceding the track lifting and lining means in the operating direction to permit leveling and lining of the track, i.e. to enable the track rails to be moved vertically and/or laterally to an extent required for leveling and lining without subjecting the rails to excessive stresses which could cause permanent deformation.

It will be understood that this invention is not limited to the illustrated and described tamping, track lifting and lining means and reference systems all of which may be selected so as to meet special requirements, such as switch tamping. The scope of the invention is defined by the appended claims.

What is claimed is:

1. A mobile machine for leveling, lining and tamping a track consisting of two rails fastened to successive ties resting on ballast, which comprises (a) an elongated, heavy, bridge-like main frame supported on two undercarriages spaced apart for continuous movement in an operating direction, (b) drive means for continuously advancing the main frame along the track in the operating direction, (c) an operator's cab, a power plant and operating control means on the main frame, (d) a lighter subframe means arranged between the two undercarriages and leading one of the undercarriages in the operating direction, (e) tamping means mounted on the subframe means for tamping ballast in intermittent tamping cycles under respective ones of the ties at points of intersection of the two rails and the respective ties, (f) track lifting and lining means associated with the two rails mounted on the subframe means ahead of the tamping means at a fixed distance therefrom and sufficiently spaced from the undercarriages in the operating direction to permit leveling and lining of the track, (1) the tamping, lifting and lining means being arranged within sight of the operator's cab, and (g) a drive connecting the lighter subframe means to the heavy main frame for adjusting the position of the subframe means in relation to the main frame in the operating direction, (1) the drive means of the main frame and the drive for the subframe means being synchronized whereby the subframe means may be held stationary intermittently with the tamping, lifting and lining means during each one of the tamping cycles while the main frame is advanced continuously, and (2) the power plant delivering power to, and the operating control means controlling, the drive and the tamping, track lifting and lining means.

2. The track leveling, lining and tamping machine of claim 1, wherein the subframe means is a single subframe and constitutes an operating unit with the tamping, track lifting and lining means.

3. The track leveling, lining and tamping machine of claim 2, further comprising a single support and guide element supporting and guiding the subframe on the track adjacent the one undercarriage of the main frame, the tamping means being arranged immediately ahead of the support and guide element and the track lifting and lining means being arranged ahead of the tamping means, in the operating direction, and a pivotal connection spaced in the operating direction from the support and guide element, the pivotal connection supporting the subframe on the main frame, the drive for the subframe being arranged at the pivotal connection.

4. The track leveling, lining and tamping machine of claim 3, wherein the subframe has the form of a steering axle-and-pole frame, the single support and guide element consisting of a pair of flanged wheels supporting a rear portion of the frame on the track and constituting the steering axle of the frame, the tamping means being mounted on the rear frame portion, and the pole of the frame being a boom-shaped carrier extending from the rear frame portion forwardly in the operating direction in a plane centrally between the wheels, the pivotal connection being arranged for pivotally connecting the boom-shaped carrier to the main frame.

5. The track leveling, lining and tamping machine of claim 4, wherein the tamping means comprises a tamping tool carrier, a drive for vertically adjusting the tamping tool carrier on the subframe, the tamping tool carrier drive projecting upwardly from the rear frame portion and the heavy main frame defining an elongated recess extending in the operating direction for receiving the upwardly projecting drive, and a plurality of pairs of vibratory and reciprocatory tamping tools mounted on the tamping tool carrier for immersion in successive cribs, with a respective one of the ties positioned between the tools of the pairs, and the track lifting and lining means comprises track lifting and lining tools and drive means for the lifting and lining tools.

6. The track leveling, lining and tamping machine of claim 5, wherein the track lifting and lining means also has the form of a steering axle-and-pole frame, a pair of flanged rollers constituting the lining tools and supporting a rear portion of the frame on the track, the flanged rollers constituting the steering axle of the frame, the drive means for the lifting and lining tools connecting the track lifting and lining means frame to the subframe, and the pole of the track lifting and lining means frame extending from the rear frame portion forwardly in the operating direction in a plane centrally between the rollers, a forward end of the track lifting and lining means frame pole being linked to the boom-shaped carrier of the subframe.

7. The track leveling, lining and tamping machine of claim 4, wherein the pivotal connection comprises a roller guide supporting the boom-shaped carrier on the main frame, the roller guide having at least one roller rotatable about a horizontal axis extending transversely to the operating direction and supporting the boom-shaped carrier on the main frame with lateral clearance, and the drive for the subframe being arranged between the main frame and the subframe for adjustably guiding the subframe along the roller guide.

8. The track leveling, lining and tamping machine of claim 7, wherein the roller guide is comprised of two pairs of said rollers rotatably journaled in the main frame, the pairs of the rollers being spaced in the operating direction a distance corresponding at least to the length of the adjustment stroke of the drive for the subframe, and the rollers of each pair having guide flanges engaging the boom-shaped carrier therebetween.

9. The track leveling, lining and tamping machine of claim 4, wherein the drive for the subframe extends in the operating direction and is arranged above the track lifting and lining means at a vertical distance from the track substantially corresponding to the height of the rear frame portion, and further comprising universal joints connecting respective ends of the drive to the main frame and the rear frame portion, respectively.

10. The track leveling, lining and tamping machine of claim 4, wherein the main frame defines an upwardly recessed portion and the subframe is arranged within the recessed main frame portion.

11. The track leveling, lining and tamping machine of claim 2, further comprising means for longitudinally adjustably connecting the operating unit to the main frame at two points spaced in the operating direction.

12. The track leveling, lining and tamping machine of claim 11, wherein the drive for the subframe comprises drive actuating means connected to the main frame.

13. The track leveling, lining and tamping machine of claim 12, wherein the drive is a double-acting hydraulic cylinder-and-piston device, the cylinder of the device constituting the drive actuating means and being linked to the machine frame.

14. The track leveling, lining and tamping machine of claim 11, wherein the means for longitudinally adjustably connecting the operating unit to the main frame comprises two longitudinal guides respectiveldy arranged along oppositely extending, lateral sides of the main frame, the guides supporting a rear portion of the subframe, in the operating direction, at one of said points and a front portion of the subframe, in the operating direction, being constituted by longitudinal carrier means supported on the main frame for guiding the subframe at the other one of said points.

15. The track leveling, lining and tamping machine of claim 14, wherein the tamping means is mounted on the rear portion of the subframe and the guides are arranged at an upper part of the rear subframe portion.

16. The track leveling, lining and tamping machine of claim 14, wherein the longitudinal carrier means is arranged for guiding the subframe between the track lifting and lining means mounted on the subframe and the other undercarriage of the main frame leading the subframe in the operating direction, and further comprising bracket means extending downwardly from the main frame for supporting the longitudinal carrier means.

17. The track leveling, lining and tamping machine of claim 11, wherein the means for longitudinally adjustably connecting the subframe to the main frame comprises roller guide means for the subframe at each one of said points, each roller guide means including a first guide means part consisting of at least two rollers rotating about horizontal axes extending transversely to the operating direction and a second guide means part consisting of a roller guide track having an upper and a lower guide face extending horizontally in the operating direction, one of the rollers engaging the upper guide face and the other one of the rollers engaging the lower guide face substantially without clearance, and one of the guide means parts being mounted on the main frame and the other one of the guide means parts being mounted on the subframe.

18. The track leveling, lining and tamping machine of claim 17, wherein at least one of the rollers has at least one flange arranged for engagement with a respective one of the lateral edges of the guide track.

19. The track leveling, lining and tamping machine of claim 11, wherein the operating unit is adjustable transversely to the operating direction with respect to the main frame in a plane of movement extending substantially parallel to a plane defined by the track, and further comprising drive means for transversely adjusting the operating unit.

20. The track leveling, lining and tamping machine of claim 19, wherein the means for longitudinally adjustably connecting the operating unit to the main frame comprises two longitudinal roller guide tracks having an upper and a lower guide face extending horizontally in the operating direction, arranged respectively along oppositely extending, lateral sides of the main frame, the guide tracks supporting a rear portion of the subframe, in the operating direction, at one of said points and at least two rollers rotating about horizontal axes extending transversely to the operating direction, one of the rollers engaging the upper guide face and the other one of the rollers engaging the lower guide face substantially without clearance, and a front portion of the subframe, in the operating direction, being constituted by longitudinal carrier means having an upper and a lower guide face extending horizontally in the operating direction, at least two additional rollers rotating about horizontal axes extending transversely to the operating direction, one of the additional rollers engaging the upper guide face and the other one of the rollers engaging the lower guide face of the longitudinal carrier means substantially without clearance, for guiding the subframe at the other one of said points, and a guide means extending transversely to the operating direction for transversely adjustably bearing a respective one of the subframe portions, the transversely extending guide means having two ends respectively connected to the two longitudinal roller guide tracks.

21. The track leveling, lining and tamping machine of claim 20, wherein the transversely extending guide means is a piston rod having a piston centrally between the piston rod ends and the drive means for transversely adjusting the operating unit comprises a double-acting hydraulic cylinder encompassing the piston rod and piston, the cylinder being affixed to the main frame or the subframe.

22. The track leveling, lining and tamping machine of claim 11, wherein the heavy main frame comprises two longitudinal carrier beams extending at respective oppositely extending, lateral sides of the main frame in the operating direction, and wherein the means for longitudinally adjustably connecting the operating unit to the main frame comprises the two longitudinal carrier beams constituting roller guide tracks having a horizontally extending upper and a lower guide face, the guide tracks supporting a rear portion of the subframe, in the operating direction, at one of said points and at least two rollers rotating about horizontal axes extending transversely to the operating direction, one of the rollers engaging the upper guide face and the other one of the rollers engaging the lower guide face substantially without clearance, the rollers having a flange engaging a lateral edge of the carrier beams, and a front portion of the subframe, in the operating direction, being constituted by longitudinal carrier means having an upper and a lower guide face extending horizontally in the operating direction, at least two additional rollers rotating about horizontal axes extending transversely to the operating direction, one of the additional rollers engaging the upper guide face and the other one of the rollers engaging the lower guide face of the longitudinal carrier means substantially without clearance, for guiding the subframe at the other one of said points.

23. The track leveling, lining and tamping machine of claim 11, wherein the means for longitudinally adjustably connecting the operating unit to the main frame comprises two double-acting hydraulic cylinder-and-piston devices, the cylinders being affixed to the subframe and constituting the drive for adjusting the position of the subframe in relation to the main frame.

24. The track leveling, lining and tamping machine of claim 23, wherein the tamping means comprises a respective tamping head associated with each one of the rails and a respective one of the cylinders is arranged above the respective tamping head.

25. The track leveling, lining and tamping machine of claim 23, each one of the two double-acting hydraulic cylinder-and-piston devices comprises a piston rod with a piston extending in the operating direction and serving to guide the subframe longitudinally, the piston rods being affixed to the main frame and the cylinders encompassing the piston rod and piston.

26. The track leveling, lining and tamping machine of claim 11, wherein the means for longitudinally adjustably connecting the operating unit to the main frame comprises four guide posts extending in vertical planes defined by the two rails and above the rails, two of said guide posts projecting from a front end at one of said points and two of said guide posts projecting from a rear end of the subframe at the other one of said points, and guide bushings affixed to the main frame and glidably receiving respective ones of the guide posts.

27. The track leveling, lining and tamping machine of claim 11, wherein the drive for adjusting the position of the subframe is constituted by a motor-driven endless chain drive arranged on the main frame, the chain having a course extending in the operating direction and being arranged to entrain the subframe in said direction.

28. The track leveling, lining and tamping machine of claim 11, wherein the drive for adjusting the position of the subframe is constituted by a rack-and-pinion drive comprising a rack extending in the operating direction and a motor-driven pinion meshing with the rack.

29. The track leveling, lining and tamping machine of claim 28, wherein the rack is affixed to the main frame and the motor-driven pinion is mounted on the subframe.

30. The track leveling, lining and tamping machine of claim 11, wherein the means for longitudinally adjustably connecting the operating unit to the main frame comprises two longitudinally adjustable links suspending the subframe for pendulum movement on the main frame at respective ends of the subframe, the links at each one of the subframe ends being arranged oppositely each other with respect to a central line extending in the operating direction, the links being pivotal about horizontal axes extending transversely to the operating direction.

31. The track leveling, lining and tamping machine of claim 30, wherein the longitudinally adjustable links are hydraulic double-acting cylinder-and-piston devices, and further comprising a control for the drive for adjusting the position of the subframe, the control being connected to the cylinder-and-piston devices and programmed to adjust the length of the links as a function of the adjustment path of the drive according to a predetermined trigonometric function.

32. The track leveling, lining and tamping machine of claim 1, wherein the drive for the subframe means is arranged to provide an adjustment path for the position of the subframe in relation to the main frame of a length at least twice the average width of the cribs between adjacent ties.

33. The track leveling, lining and tamping machine of claim 32, wherein the drive is a double-acting hydraulic cylinder-and-piston device and comprises a valve arrangement controlling the piston movement of the device synchronously with, but in the opposite direction, of the continuous advance of the main frame.

34. The track leveling, lining and tamping machine of claim 33, further comprising an odometer means connected to the valve arrangement for measuring the advance during each tamping cycle, the odometer means controlling the valve arrangement in response to the measured advance for controlling the hydraulic pressure on the piston and thereby controlling the piston movement in response to the measured distance.

35. The track leveling, lining and tamping machine of claim 33, further comprising a measuring element connected to the valve arrangement for measuring the adjustment path, the measuring element controlling the valve arrangement in response to the measured adjustment path for controlling the hydraulic pressure on the piston and thereby controlling the piston movement in response to the measured adjustment path.

36. The track leveling, lining and tamping machine of claim 33, further comprising an inductive signal transmitter connected to the valve arrangement, the transmitter being mounted on the subframe and being arranged for cooperation with, and for centering with respect to, respective fastening elements affixing the rails to the ties, the transmitter emitting a stronger or weaker control signal upon deviation of the transmitter from a centered position with respect to the respective fastening elements and in dependence on the direction of deviation, and the valve arrangement being responsive to the control signal for controlling the hydraulic pressure on the piston and thereby controlling the piston movement.

37. The track leveling, lining and tamping machine of claim 1, further comprising a sensing element mounted on the subframe means between the ballast tamping means and the track lifting and lining means for measuring the position of the track, a leveling and lining reference system having a rear end point, in the operating direction, the sensing element cooperating with the reference system, and computer means associated with the sensing element for determining a variable distance of the sensing element from the reference system rear end point when the position of the subframe means is adjusted in relation to the main frame and for correcting a respective value measured by the sensing element according to the determined distance.

38. The track leveling, lining and tamping machine of claim 37, further comprising a potentiometer for determining the relative position of the subframe means to the main frame, the computer means being connected to the potentiometer.

* * * * *